US007617773B2

(12) United States Patent
Schroeder et al.

(10) Patent No.: US 7,617,773 B2
(45) Date of Patent: Nov. 17, 2009

(54) BLANKET SIZE VERIFICATION USING DRIVE TORQUE FEEDBACK

(75) Inventors: Lothar John Schroeder, Portsmouth, NH (US); Kevin Lauren Cote, Durham, NH (US); Glen Courtland Jerry, Dover, NH (US)

(73) Assignee: Goss International Americas, Inc., Durham, NH (US)

( * ) Notice: Subject to any disclaimer, the term of this patent is extended or adjusted under 35 U.S.C. 154(b) by 153 days.

(21) Appl. No.: 11/444,569

(22) Filed: Jun. 1, 2006

(65) Prior Publication Data

US 2007/0277691 A1 Dec. 6, 2007

(51) Int. Cl.

| | |
|---|---|
| ***B41F 1/54*** | (2006.01) |
| ***B41F 1/66*** | (2006.01) |
| ***B41L 5/12*** | (2006.01) |
| ***B41L 39/00*** | (2006.01) |
| ***B41L 47/56*** | (2006.01) |
| ***B41F 5/00*** | (2006.01) |

(52) U.S. Cl. ..... 101/484; 101/216

(58) Field of Classification Search ..... 101/178, 101/179, 180, 216, 219, 220, 221, 483, 484; 702/41, 44

See application file for complete search history.

(56) References Cited

U.S. PATENT DOCUMENTS

| | | | | |
|---|---|---|---|---|
| 3,938,041 | A * | 2/1976 | Louth et al. | 324/772 |
| 5,950,536 | A * | 9/1999 | Erbstein | 101/177 |
| 5,983,794 | A | 11/1999 | Emery | 101/217 |
| 6,433,499 | B1 * | 8/2002 | Cote et al. | 318/432 |
| 6,499,639 | B2 * | 12/2002 | Cote et al. | 226/42 |
| 6,546,867 | B1 * | 4/2003 | Franklin et al. | 101/378 |
| 6,556,798 | B2 * | 4/2003 | Rimai et al. | 399/167 |
| 6,684,776 | B2 * | 2/2004 | Cote et al. | 101/228 |
| 2005/0000333 | A1 * | 1/2005 | Schittl et al. | 83/13 |

* cited by examiner

*Primary Examiner*—Judy Nguyen
*Assistant Examiner*—Leo T Hinze
(74) *Attorney, Agent, or Firm*—Davidson, Davidson & Kappel, LLC

(57) ABSTRACT

A device is provided for determining incorrectly sized or manufactured blankets includes a first blanket on a first blanket cylinder independently driven by a first motor, a first controller for determining torque values of the first motor, a second blanket on a second blanket cylinder independently driven by a second motor, a second controller for determining torque values of the second motor. A processor determines the existence of a size difference between the first and second blankets as a function of the torque values of the first and second motors. A method for comparing blankets is also provided.

13 Claims, 2 Drawing Sheets

BLANKET SIZE VERIFICATION USING DRIVE TORQUE FEEDBACK

BACKGROUND OF THE INVENTION

The present invention relates generally to printing presses and more specifically, web offset printing presses with blanket cylinders.

U.S. Pat. No. 5,983,794 discloses an imprinter printing unit of a web fed rotary printing press including a first plate cylinder and a first blanket cylinder which form a first print couple for printing on a first side of a running paper web. The printing unit further includes a second plate cylinder and an associated second blanket cylinder which form a second print couple for printing on a second side of the web. The printing unit further includes a gear arrangement for coupling the first and second print couples to first and second drive motors in order to drive the cylinders in such a way that in the first mode of operation the first drive motor drives the first print couple and the second drive motor independently drives the second print couple.

SUMMARY OF THE INVENTION

Using independently driven blankets may increase the need for controlling variations in blankets, such as size and construction. If blanket sizes are mismatched, the forces applied to the substrate may adversely influence print quality. As a substrate passes between blankets, the blankets may rotate in opposite directions, for example, one blanket rotates clockwise while the other blanket rotates counterclockwise. At the nip, the blankets, while rotating in opposite directions, apply a force to the substrate in the same lateral direction, moving the substrate downstream through the printing process.

If one blanket has a different diameter, construction or velocity, the blankets apply different forces on the substrate. When unequal forces are applied to the substrate, the substrate is strained and print quality is adversely affected. Thus, it may be desirable for blankets to apply equal forces on the printing substrate. If the blankets have different diameters, constructions or velocities, a change in motor torque may be necessary to maintain the blanket cylinders' desired rotational velocity.

Currently, blanket measurements are taken after manufacturing, while the blankets are offline. Blankets then can be manually matched to ensure print quality.

An object of the present invention is to determine if blankets are incorrectly sized. Controllers regulate rotational velocity and angular position for each independently driven blanket. Thus, controllers provide the torque necessary to overcome circumferential differences in blanket size and construction. This torque can be monitored and used to determine the magnitude of incorrectly sized or manufactured blankets. The torque may be measured before and after the blankets make contact. A large increase in the torque difference after blanket contact may be a result of a difference in the blankets, for example, blanket size, blanket construction, etc.

By providing a device for determining incorrectly sized or manufactured blankets, the blankets, such as those in a blanket-to-blanket printing press, can be monitored. The device signal the need for cleaning, washing or other potential problems before they occur.

The present invention provides a device for determining incorrectly sized or manufactured blankets comprising:

a first blanket on a first blanket cylinder independently driven by a first motor;

a first controller for determining torque values of the first motor;

a second cylinder independently driven by a second motor;

a second controller for determining torque values of the second motor; and a processor determining a size of the first blanket as a function of the torque values of the first and second motors.

The present invention also provides a method for determining a size of a first blanket on a first blanket cylinder to a cylindrical structure comprising the steps of:

determining a first torque value from a first blanket cylinder and determining a second torque value from the second cylindrical structure when the first blanket cylinder and second cylindrical structure are contacting each other; and comparing the first and second torque values.

The present invention also may provide a method for using a blanket that is a reference blanket with a known characteristic. The known characteristic may be for example, diameter, thickness or a trait of blanket construction. Thus, the reference blanket may be used to determine which blanket is larger or smaller or which blanket should be changed.

Alternatively, the first blanket may be tested against a solid cylinder.

BRIEF DESCRIPTION OF THE DRAWINGS

A preferred embodiment of the present invention will be elucidated with reference to the drawings, in which.

DETAILED DESCRIPTION OF A PREFERRED EMBODIMENT

Figure 1:
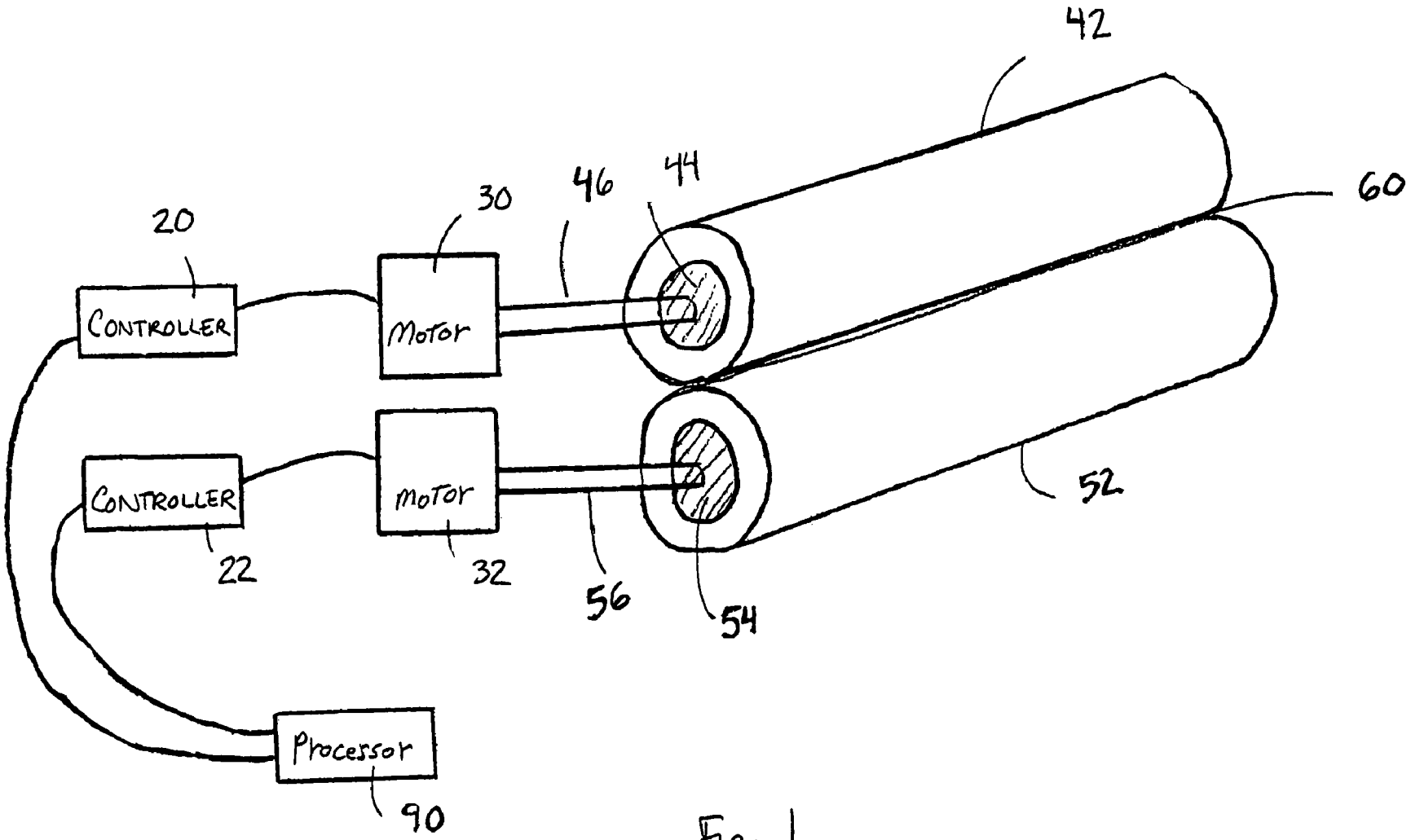
FIG. 1 shows independently driven blanket cylinders according to the present invention.

FIG. 1 shows two independently driven blanket cylinders, upper cylinder 44 and lower cylinder 54 with upper blanket 42 and lower blanket 52, respectively. Upper cylinder 44 is coupled to an upper motor 30 via shaft 46. Lower cylinder 54 is coupled to a lower motor 32 via a shaft 56. Each motor 30, 32 is connected to a controller 20, 22, respectively. When blanket cylinders 44, 54 are independently driven, the torque requirements for motors 30, 32 are similar if blankets 42, 52 are properly matched. Cylinders also may be coupled to the motors via gears, pulleys or other transmission devices.

Controllers 20, 22 maintain similar motor velocities for corresponding motors 30, 32. At a nip 60 a force develops between blankets 42, 52 when blankets 42, 52 contact each other. Controllers 20, 22 try to maintain similar angular velocities while blankets 42, 52 try to maintain similar surface velocities due to the contact between the blankets. If the diameters of blankets 42 and 52 are different the torque differs at the motors 30, 32.

After blankets 42, 52 are cleaned of ink, paper or other buildup accumulated from the offset printing process, initial torques for motors 30, 32 are determined by controllers 20, 22 respectively, when blankets 42, 52 are thrown off, before contact. Processor 90 stores the torque data determined by controllers 20, 22. A second set of torque data are determined and stored in processor 90 when blankets 42, 52 are thrown on.

Processor 90 compares the torque difference between controllers 20 and 22 before and after blankets 42, 52 are thrown on and determines if the torque difference greatly increases once blankets 42, 52 are contacting. A large difference in torque after blankets 42, 52 contact signals a large difference in blanket diameter. The controller 20, 22 that determines the larger difference in torque between the first and second set of torque measurements is connected to the blanket cylinder 44, 54 with the larger diameter blanket 42, 52. Thus, processor 90 can detect if blankets 42, 52 are incorrectly matched sized or manufactured and which blanket 42, 52 is larger or smaller.

An operator via an operator interface may input a predetermined set of data. The set may include a predetermined setpoint or setpoints for measurements acceptable for printing corresponding to, for example, torque measured in motors 30, 32. Thus, processor 90 compares the predetermined setpoints with the torque measured in motors 30, 32. Processor 90 alerts an operator if data is outside a predetermined setpoint. If applicable, processor 90 alerts an operator which blanket 42, 52 is larger or smaller.

Figure 2:
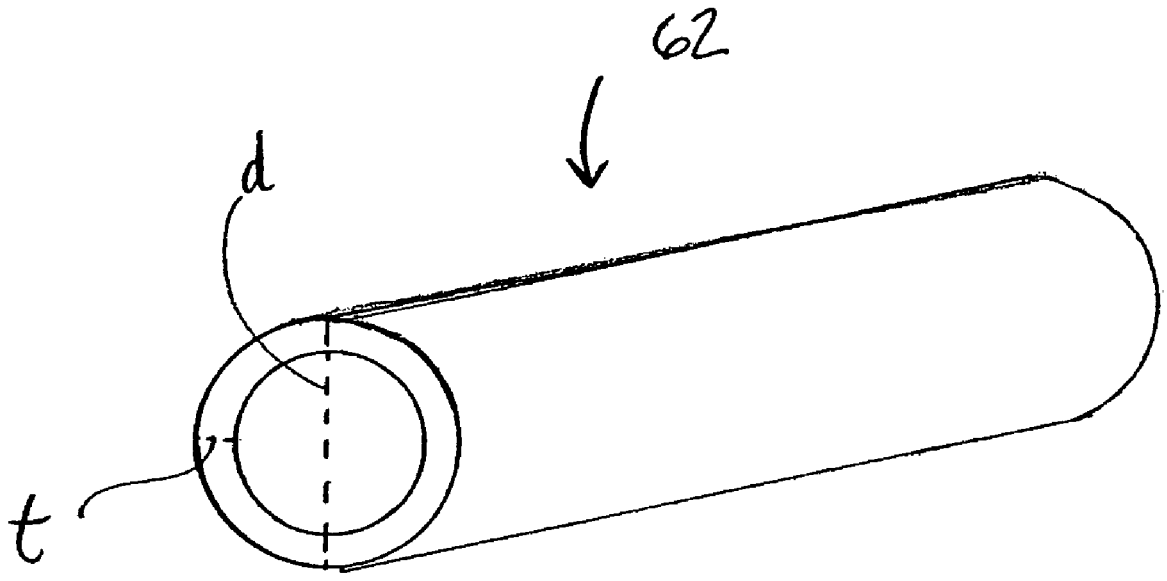
FIG. 2 shows a reference blanket.

FIG. 2 shows a reference blanket 62. A reference blanket 62, with a diameter d and a thickness and construction t, may be used to determine if blankets 42, 52 in FIG. 1 are suitable for use. Reference blanket 62 has a known, correct diameter and construction. Reference blanket 62 may be maintained, for example, by using only for reference and not for printing. As an alternative, the blankets 42, may be tested against a solid cylinder drive by motor 32 for example, the cylinder also could simply be cylinder 54 with blanket 52 removed.

An operator uses information collected by processor 90 to determine which blanket 42, 52 to remove. Operator may choose to remove the larger blanket, for example upper blanket 42. Operator replaces upper blanket 42 with reference blanket 62. Torques are determined when blankets 52, 62 are thrown on contact.

If the new torque data are acceptable, as defined by the set of predetermined data inputted by the operator, then existing blanket 52 is acceptable for use in the printing process. The operator can replace reference blanket 62 with a new or existing blanket known to be suitable for use in the printing process. The removed blanket 42 may be discarded or marked larger and saved for alternative use.

Alternatively, torque data may be outside the set of predetermined data inputted by the operator. If controller 20 determines a torque reading higher then controller 22, reference blanket 62 is larger than blanket 52. Thus, blanket 52 must be replaced with a blanket of suitable size. Blanket 52 may be discarded or marked smaller and saved for alternative use. Alternatively, if controller 20 determines a torque reading smaller then controller 22, reference blanket 62 is smaller than blanket 52. Thus, blanket 52 must be replaced with a blanket of suitable size. Blanket 52 may be discarded or marked larger and saved for alternative use resulting in reduced waste.

Thus, processor 90 monitors torque differences, allows for an online detection system before printing occurs and allows for verification to eliminate blanket diameter differences as the cause of poor print quality.

An additional embodiment of the present invention may determine and record a history of torque readings while printing. Processor 90 can monitor variables such as the increase in torque and change in direction over time. These variables can be compared to reference data and tolerances to determine when blankets need washing or signal potential problems. Thus, blankets can be cleaned or investigated before a printing problem may occur.

Differences in blanket construction may also cause torque differences, so it is also desirable to monitor torque differences due to blanket construction. Furthermore, the same technique may be employed by blanket manufacturers as a method of quality control to verify blanket diameters and construction.

In the preceding specification, the invention has been described with reference to specific exemplary embodiments and examples thereof. It will, however, be evident that various modifications and changes may be made thereto without departing from the broader spirit and scope of the invention as set forth in the claims that follow. The specification and drawings are accordingly to be regarded in an illustrative manner rather than a restrictive sense.

What is claimed is:

1. A device for determining incorrectly sized or manufactured blankets comprising:

a first blanket on a first blanket cylinder independently driven by a first motor;

a first controller for determining torque values of the first motor;

a second cylinder independently driven by a second motor;

a second controller for determining torque values of the second motor; and a processor determining a size of the first blanket as a function of the first and second torque values of the first and second motors.

2. A device as recited in claim 1 further comprising a second blanket on a second cylinder.

3. The device as recited in claim 2 wherein the first or second blanket is a reference blanket having at least one known characteristic.

4. The device as recited in claim 2 wherein the reference blanket has a known diameter.

5. The device as recited in claim 2 wherein the reference blanket has a known construction.

6. The device as recited in claim 2 wherein the reference blanket has a known thickness.

7. A web offset printing unit including the device for determining blanket size mismatch as recited in claim 1.

8. A method for determining a size of a first blanket on a first blanket cylinder comprising the steps of:

determining a first torque value from a first blanket cylinder and determining a second torque value from a cylindrical structure when the first blanket is contacting the cylindrical structure;

comparing the first and second torque values; and determining the size of the first blanket as a function of the comparing step.

9. The method as recited in claim 8 wherein the cylindrical structure includes a reference blanket having at least one known characteristic.

10. The method as recited in claim 8 further comprising comparing at least one characteristic of the first blanket and cylindrical structure as a function of the torque values.

11. The method as recited in claim 10 wherein at least one characteristic is size.

12. The method as recited in claim 10 wherein the at least one characteristic is blanket construction.

13. The method as recited in claim 8 wherein comparing the torque values includes comparing the torque values to known data.

* * * * *